US007041925B2

(12) United States Patent
Gates

(10) Patent No.: US 7,041,925 B2
(45) Date of Patent: May 9, 2006

(54) APPARATUS FOR THE ELECTROSTATIC SEPARATION OF PARTICULATE MIXTURES

(75) Inventor: Peter J. Gates, Worongary (AU)

(73) Assignee: Ore Kinetics Investments Pty., Ltd., Queensland (AU)

( * ) Notice: Subject to any disclaimer, the term of this patent is extended or adjusted under 35 U.S.C. 154(b) by 120 days.

(21) Appl. No.: 10/333,932

(22) PCT Filed: Jul. 27, 2001

(86) PCT No.: PCT/AU01/00917

§ 371 (c)(1),
(2), (4) Date: Jan. 24, 2003

(87) PCT Pub. No.: WO02/09882

PCT Pub. Date: Feb. 7, 2002

(65) Prior Publication Data

US 2005/0061713 A1 Mar. 24, 2005

(30) Foreign Application Priority Data

Jul. 27, 2000 (AU) ..... PQ9022

(51) Int. Cl.
*B03C 7/06* (2006.01)

(52) U.S. Cl. ..... 209/127.1; 209/127.2; 209/128; 209/129

(58) Field of Classification Search ..... 209/127.1–131
See application file for complete search history.

(56) References Cited

U.S. PATENT DOCUMENTS 827,770 A * 8/1906 Woodsome ..... 209/130
859,998 A * 7/1907 Wentworth ..... 209/127.1
1,153,182 A * 9/1915 Scniewind ..... 209/127.1
2,314,940 A * 3/1943 Hewitt ..... 209/127.1
2,559,076 A * 7/1951 Johnson ..... 209/127.4
3,031,079 A * 4/1962 Boss ..... 209/128
3,322,275 A * 5/1967 Breakiron et al. ..... 209/127.1
3,969,225 A * 7/1976 Horowitz ..... 209/127.2
3,970,546 A * 7/1976 Webb et al. ..... 209/3
4,251,353 A * 2/1981 Knoll ..... 209/129
4,341,744 A * 7/1982 Brison et al. ..... 423/206.2
5,704,490 A * 1/1998 Reynard ..... 209/128
5,967,331 A * 10/1999 Katyshev et al. ..... 209/127.4
6,365,857 B1 * 4/2002 Maehata et al. ..... 209/127.3
6,390,302 B1 * 5/2002 Abrarov et al. ..... 209/12.2
6,415,929 B1 * 7/2002 Maehata et al. ..... 209/12.2

(Continued)

FOREIGN PATENT DOCUMENTS

JP 2000354790 A 6/1999

(Continued)

*Primary Examiner*—Donald P. Walsh
*Assistant Examiner*—Jonathan R. Miller
(74) *Attorney, Agent, or Firm*—Jennifer L. Skord; Moore & Van Allen PLLC

(57) ABSTRACT

Apparatus for the electrostatic separation of a mixture of particles that exhibit difference in electrical conductivity, comprising: a conductive surface to which conducting particles lose their charge; feeding means for feeding the mixture of particles onto the conductive surface; an ionising electrode for ionising individual particles in the mixture of particles; and a first static electrode having the same polarity as the ionising electrode and which serves to generate a static electric field, the first static electrode being located sufficiently close to the ionising electrode that the static electric field acts continuously on the particles as they are ionised; wherein conducting particles are separated from non-conducting particles on the basis of their different retained charge after a period of contact with the conductive surface.

12 Claims, 8 Drawing Sheets

U.S. PATENT DOCUMENTS 6,467,628 B1 * 10/2002 Maehata et al. ..... 209/12.2
6,720,514 B1 * 4/2004 Inoue et al. ..... 209/128
6,723,938 B1 * 4/2004 Gates ..... 209/128
6,774,332 B1 * 8/2004 Maehata et al. ..... 209/128
6,789,679 B1 * 9/2004 Abrarov et al. ..... 209/12.2
6,797,908 B1 * 9/2004 Yan et al. ..... 209/131
2003/0192814 A1 * 10/2003 Yan et al.

FOREIGN PATENT DOCUMENTS

RO 109038 B1 8/1992
SU 1282-903 A 1/1987

* cited by examiner

APPARATUS FOR THE ELECTROSTATIC SEPARATION OF PARTICULATE MIXTURES

TECHNICAL FIELD

The present invention is concerned with a particle separator for the separation of particulate mixtures comprising species that exhibit difference in electrical conductivity and, more particularly, with the separation of particulate mixtures comprising species that exhibit difference in electrical conductivity through electrostatic separation.

BACKGROUND ART

Mineral separation plants used in the titanium mineral processing industry world-wide consist essentially of similar process technologies applied in a manner that is often tailored to an individual ore bodies separation requirements. Dependent upon a wide number of factors including particle size and shape, mineral grade, geology of the ore body, type of mineral species present and the physical characteristics of said mineral species, a unique recovery process is applied to optimise plant performance and satisfy operational and capital cost targets. Nevertheless, all titanium mineral processing plants in the world utilise similar process technologies applied in varying ways to accomplish their process needs.

Mining is carried out by firstly excavating the ore and subjecting it to gravity concentration which isolates the heaviest particles into what is termed a heavy mineral concentrate. The heavy mineral concentrates are sent to a dry separation plant, where individual minerals species (of which there may up to 20 or more present) are separated using their different magnetic, electrical or other physical properties, often at elevated temperatures. Separation equipment commonly includes but is not limited to, high-tension electrostatic roll (HTR) and electrostatic plate (ESP) separators, as well as gravity and magnetic processes. Using electrostatic separation techniques the conductors such as rutile and ilmenite are separated from the non-conductors such as zircon, quartz and monazite. These separators are extensively used for the separation of conductor and non-conductor mineral species typically found in the titanium minerals industry.

A wide variety of electrostatic induced charge and ionised field separators have been invented over the last 90 years however the devices of existing commercial designs described below have undergone little fundamental change in recent years.

Based on the charging mechanisms employed, three basic types of "electrostatic" separators include; (1) high tension roll ionised field separators (HTR), (2) electrostatic plate and screen static field separators (ESP and ESS herein called ESP) and (3) triboelectric separators. ESP and HTR separators are the most commonly used today, although in recent times some interest has been directed towards triboelectric separators. However their application remains limited to mineral species that can be contact charged and so they are suitable for separations of non-conductor species only.

Customarily, HTR separators utilise a grounded roll that transports the feed material through the high voltage ionising field (corona) which charges the particles by ion bombardment. Conducting particles lose their charge to the earthed roll and are thrown from the roll by centrifugal and gravity forces. Non-conducting particles are pinned to the rotor and are transported further around the roll before their charge either dissipates and they are thrown off or are removed by either mechanical means (brush) or high voltage AC wiper.

ESP separators have an electrode designed to generate a static field and the particles are charged by conductive induction. In their common form ESP separators utilise a stationary grounded surface such as a plate over which the material flows, forming the connection to ground that particles must have to allow them to become charged by induction. Triboelectric separators do not use an electric field to effect particle charging. Particle to particle and/or particle to surface charging occurs when particle species with different contact charging potential are brought into contact with one another. The particle charge attained can then be utilised to effect a separation in a static electric field.

These three basic separation types are often not present alone in any mechanism, and the machine characterisation essentially refers to the predominant or major separating effect. The present invention relies primarily on ion bombardment to charge the particles and so the operation of a HTR separator is described in more detail below.

The main separating mechanism employed in HTR separators involves the fact that conductors will quickly release their charge to a grounded surface and accordingly will be thrown off the rotating roll surface due to the centrifugal or gravitational forces. Non-conductors being unable to conduct their charge to the grounded surface are pinned to the roll surface. An "image force" pins the non-conductors to the roll and it can be shown that the image charge developed on the conducting surface is related to the particle charge and its distance from the roll surface. If the particle charge is negative, it repels electrons in the image vicinity in the conducting roll i.e. it generates its own positive image. This image has opposite polarity and the particle is attracted and pinned to the roll surface for this reason.

Thus the conductors tend to be thrown off the roll surface by their natural gravitational and centrifugal forces before falling through a splitter type collection means below and/or beyond the roll, dividing the feed into a conductor rich fraction and a conductor poor, or non-conductor, fraction.

Individual particle mass and shape partially determine the behaviour of individual particles in the separator and also the path followed by a particular particle once it has left the roll surface.

The above description of the separation process describes a one-stage HTR separator. HTR separators typically incorporate up to 3 identical stages with up to two starts or individual streams being treated in one machine. Very simple separations such as removing highly conductive ilmenite from good non-conductors can often be effected with just one stage. Nevertheless, in a multi-stage machine each new stage follows the last with material cascading from one stage to the next. Conductor or non-conductor retreat configurations are common.

Each stage is similar to the first with feed chute, earthed roll, electrode and splitter system duplicated and arranged one above the other in a vertical configuration. Adjustment of splitters, electrode position and roll speed is typically done at each stage independently of other stages.

In the treatment of mixtures of particles with a range of physical characteristics including conductivity, particle size and density, it is necessary to accurately set roll speed and relative positions of the electrode and splitters to achieve effective separation. It is usually necessary to adjust not only the air gap between the roll and electrode but also the alignment of the wire electrode and its backing member relative to the roll surface as well as the splitter positions, independently on each stage.

It is found in conventional HTR separators that not all particles contact the roll for sufficient duration to enable the conductors to be discharged and thrown Some of the particles which are fed onto the roll bounce up upon contact with the roll, as it rotates at relatively high speed. This results in lower separation efficiency. In addition, feed streams containing particles with low conductivity, such as leucoxene, may be incompletely separated as a result of incomplete discharge. Furthermore, feed streams in which there is wide particle size variation, particularly where the non-conductors are larger than the conductors, and feed streams containing fine particles below 75 microns in size may be incompletely separated. The present invention provides a means for minimising particle bounce and enhancing charge decay in conducting particles in order to improve separation efficiency.

DISCLOSURE OF THE INVENTION

Accordingly to one aspect of the present invention there is provided an apparatus for the electrostatic separation of a mixture of particles that exhibit difference in electrical conductivity, comprising:

a conductive surface to which conducting particles lose their charge;

feeding means for feeding the mixture of particles onto the conductive surface;

an ionising electrode for ionising individual particles in the mixture of particles; and a first static electrode having the same polarity as the ionising electrode and which serves to generate a static electric field, the first static electrode being located sufficiently close to the ionising electrode that the static electric field acts continuously on the particles as they are ionised;

wherein conducting particles are separated from non-conducting particles on the basis of their different retained charge after a period of contact with the conductive surface.

It will be appreciated that the first static electrode ordinarily has its leading edge closely adjacent the ionising electrode, and preferably has its leading edge located behind the ionising electrode with respect to the conductive surface. This ensures that the static electric field generated by the first static electrode acts continuously upon the ionised particles both during and after the ionising process. This, in turn, ensures that there is a repelling action on all particles, both conducting and non-conducting, tending to force them back onto the conductive surface. Accordingly, particle bounce is minimised and particle contact with the conductive surface is maximised. As a result, the maximum opportunity for conducting particles to discharge their charge to the conductive surface is provided, and therefore separation of conducting and non-conducting particles is enhanced. This effect is most pronounced with the larger and heavier non-conductors since these are most likely to bounce off the conductive surface and consequently misreport to the conductor stream. However, since these particles still carry most of the charge attained when ionised they are continuously repelled by the first static electrode and therefore substantially less likely to join the conductor stream.

A convenient spacing for the ionising electrode and the first static electrode is in the range of 2 to 20 mm, preferably 5 to 10 mm, but this may differ dependent upon the precise process conditions.

Advantageously, the ionising electrode is a corona electrode, and the corona electrode includes a corona wire which is stretched in space. Advantageously, the corona wire is stretched to between two tensioning screws that tension the wire above a backing bar, and this wire support assembly may be attached by means of clips to the first static electrode.

It is desirable that the spacing of the ionising electrode and the first static electrode be adjustable, and therefore the apparatus may include adjustment means for adjusting the spacing of the first static electrode and the ionising electrode.

In one form of the invention, the corona wire position relative to the static electrode may be changed by adjusting the length of the tensioning screws that support the corona wire. An alternative and preferred method of changing the relative ionising effect and the static conductive induction effect is to use two or more high voltage power supplies, one connected to the corona wire and at least one other connected to the first static electrode. In this way the ionising effect and hence the pinning forces and the conductive induction charge decay effects can be decoupled, allowing the separation process to be optimised. However, any other arrangement suitable for spacing the ionising electrode and the first static electrode may be used. For example, the leading edge of the first static electrode may be spaced apart from the ionising electrode through a perforated plate, which acts as a spacer. In this arrangement the leading edge of the first static electrode would generally be fixed to one portion of the plate and the ionising electrode, typically a corona wire, may penetrate any one of a plurality of perforations. Each of the perforations is spaced apart by a different distance from the first static electrode, and therefore the distance between the corona wire and the first static electrode may be adjusted.

It will also be appreciated that the first static electrode acts upon the particles as they are ionised, but may be of sufficient length to also act on ionised particles. Since the first static electrode has the same polarity as the ionising electrode it will assist in the charge decay of the conducting particles. For example, if both the ionising electrode and the first static electrode have positive polarity, all particles become initially positively charged due to ion bombardment. The charged particles will then start to give up their charge to the conductive surface by their own natural decay, but the first static electrode will also force their charge reversal as it endeavours to induce a negative charge in them. Accordingly, the charge decay is performed more quickly than in prior art devices, allowing the conducting particles to be thrown or lifted from the roll at an earlier point whilst at the same time forcing charged non-conductors to remain pinned to the roll surface for a longer time. In some forms of the invention the static electric field generated by the first static electrode even acts on the conductive surface at a point beyond where separation of conducting and non-conducting particles occurs to continue to hold the non-conducting particles back to the conductive surface. In particular, very large or heavy particles are maintained on the conductive surface in this fashion. This ensures that they remain in contact with the surface for sufficient time to join the non-conductor stream. There may even be a second static electrode present in the apparatus which serves to extend the distance over which the static electric field is applied to the conductive surface. This embodiment of the invention, in particular, minimises sensitivity to particle size variation compared to prior art separators, thereby contributing to improved separator performance.

In a further aspect of the present invention there is provided apparatus for the electrostatic separation of a mixture of particles that exhibit difference in electrical conductivity, comprising:

a rotating roll whose exterior surface is conductive;

feeding means for feeding the mixture of particles onto the exterior surface of the rotating roll;

an ionising electrode for ionising individual particles in the mixture of particles; and a first static electrode having the same polarity as the ionising electrode; and a second static electrode having the same polarity as the ionising electrode but positioned further around the rotating roll so as to extend the static electric field generated by the first static electrode;

wherein conducting particles lose their charge to the exterior surface of the rotating roll after a period of contact therewith and so are thrown off, while non-conducting particles are retained on the exterior surface of the rotating roll.

In a particularly preferred embodiment of the present invention, the apparatus is a roll-type ionised field separator in which the conductive surface is the exterior surface of a rotating roll.

Accordingly in a still further aspect of the present invention there is provided an apparatus for the electrostatic separation of a mixture of particles that exhibit difference in electrical conductivity, comprising:

a rotating roll whose exterior surface is conductive;

feeding means for feeding the mixture of particles onto the exterior surface of the rotating roll;

an ionising electrode for ionising individual particles in the mixture of particles; and a first static electrode having the same polarity as the ionising electrode and which serves to generate a static electric field, the first static electrode being located sufficiently close to the ionising electrode that the static electric field acts continuously on the particles as they are ionised;

wherein conducting particles lose their charge to the exterior surface of the rotating roll after a period of contact therewith and so are thrown off, while non-conducting particles are retained on the exterior surface of the rotating roll.

It is preferred that the rotating roll should rotate relatively slowly since this increases the time that the particles spend within the electric field produced by the or each static electrode and therefore enhances separation. A preferred roll speed is around 150 to 250 rpm. Separation may also be enhanced by increasing the electrical field strength, and typically voltages in the range of 15 to 40 kV may be applied to all electrodes in the apparatus. The voltage applied to the electrodes may be the same or different.

Advantageously, one or both of the first and second static electrode is a dielectric electrode. Such electrodes may be constructed in the manner described in International Application No. PCT/AU00/00223 (WO 00/56462), the disclosure of which is incorporated herein by reference. The use of a dielectric semi-conductor or non-conductor electrode is preferred, but a metal electrode may also be used. It will be appreciated that the dielectric electrode may easily be arranged in very close proximity with the ionising electrode, and the close proximity of the electrode to the roll surface allows higher field strengths to be obtained. Metal static electrodes may also allow charge transfer to conductor particles which strike the electrode, and therefore some misreporting may occur. Nevertheless, they form a part of the invention, although a less preferred embodiment.

It is desirable for either static electrode, but particularly the second static electrode, to follow the conductive surface. Thus, for a rotating roll it is desirable that the electrode or electrodes be curved, and have substantially the same degree of curvature as the surface of the roll. It will also be appreciated that conductor particles which are thrown off the roll could strike a static electrode with an impervious surface, unless precautions were taken to prevent this. However, this may be minimised through use of a finger electrode in which a plurality of spaced apart fingers constitute the electrode. The fingers may be substantially parallel and mounted to a base member, typically at regular intervals. Advantageously insulated wire fingers are cantilever supported to the base member. These may be installed concentric with the surface of the roll. However, it will be appreciated that finger electrodes may have other configurations which generate a substantially uniform static electric field at the surface of the roll. For example, fingers may extend laterally across the surface of the roll with each finger positioned a predetermined distance from the roll so as to generate a substantially uniform static electric field at the surface of the roll. The fingers in this embodiment may be supported by a member located to one side of the roll to which all of the fingers are joined.

The individual fingers are spaced apart at a distance that provides a reasonably uniform electric field strength at the roll surface. In a preferred embodiment of the invention the spacing is typically 20 to 75 mm, but may be more or less dependent upon the other operational perimeters. It will also be appreciated that the fingers need not be curved, but the maximum advantage is gained when they are curved to reflect the surface of the roll. In either case it will be appreciated that particles thrown from the roll will ordinarily pass between the fingers, and even on those occasions where they strike the fingers they will normally do so in a glancing fashion and not be substantially deflected. Therefore, the provision of a finger electrode minimises misreporting through deflection of the particles.

According to a still further aspect of the present invention there is provided a finger electrode comprising a plurality of substantially parallel spaced apart fingers mounted at regular intervals to a base member, and further comprising appropriate electrical connections.

The apparatus of the present invention also advantageously includes a mineral wiping brush to remove non-conducting particles from the conductive surface. This is typically a fibre or brass bristle brush which is in continuous contact with the conductive surface. An alternating current (AC) electrode may be located adjacent the brush enabling the charged particles to be neutralised. The non-conducting particles may either fall from the roll or be brushed from the roll once neutralised.

However, in addition, it has been found that conventional electrostatic separators have a propensity for the conductive surface to attract and become coated with non-conductive organic or inorganic film after hours or days of operation. As good electrical contact between the particles and the conductive roll surface is highly desirable, it is preferred that the apparatus further comprise cleaning means for cleaning the conductive surface. Since the cleaning means is generally an abrasive brush or pad, it is desirable that it contact the conductive surface only intermittently. A typical cleaner is a rotating abrasive linish roll, but an abrasive wire brush or an abrasive cloth or any other conventional cleaner for such surfaces may be used. It is desirable that the abrasive cleaner only be used for short periods, as continuous contact may result in rapid erosion of the conductive surface.

In a particularly preferred embodiment of the invention, a rotating abrasive linish roll which has a rounded face and a flattened face is used. This roll rotates continuously or intermittently adjacent the exterior surface of the roll so as to contact it only when the rounded face and the conductive surface are juxtaposed. When the flattened face and the conductor surface are close together, the flattened face does not reach to the surface of the roll.

In a still further aspect of the present invention there is provided a cleaning device for cleaning a conductive surface on which separation occurs in an apparatus for separating particles on the basis of difference in their electrical conductivity, comprising a rotating, abrasive roll which has a rounded face and a flattened face and rotates continuously or intermittently adjacent the conductive surface so as to contact it only when the rounded face and the conductive surface are juxtaposed.

In a still further aspect of the present invention there is provided an apparatus for the electrostatic separation of a mixture of particles that exhibit difference in electrical conductivity, comprising:

a rotating roll whose exterior surface is conductive;

a feed slide or roll feeder which feeds the mixture of particles onto the exterior surface of the rotating roll;

a corona electrode for ionising individual particles in the mixture of particles;

a first static electrode having the same polarity as the ionising electrode and which serves to generate a static electric field, the first static electrode being located sufficiently close to the ionising electrode that the static electric field acts continuously on the particles as they are ionised; and a mineral wiping brush which brushes the exterior surface of the rotating roll;

wherein conducting particles lose their charge to the exterior surface of the rotating roll after a period of contact therewith and so are thrown off, while non-conducting particles are retained on the exterior surface of the rotating roll until brushed off.

The apparatus may also include an AC wiper which neutralises the charge on the non-conducting particles.

Separation roll diameter is not critical. Typically the diameter of the roll in the apparatus described above will be between 150 mm and 1000 mm, preferably between 200 and 400 mm. However, there is a balance of issues regarding roll size in that single stage performance is improved with larger roll diameters, but the increased machine size and cost needs to be weighed up against the benefits of installing a greater number of smaller diameter rolls. These rolls may typically be used in a multi-stage apparatus.

The present invention also allows for a multi-stage particle separator comprising apparatus as described above in operative association with a further particle separator or separators, which is typically also apparatus as described above.

BRIEF DESCRIPTION OF THE DRAWINGS

Preferred embodiments of the present invention will now be described, by way of example only, with reference to the accompanying drawings, in which.

MODES FOR CARRYING OUT THE INVENTION

Figure 1:
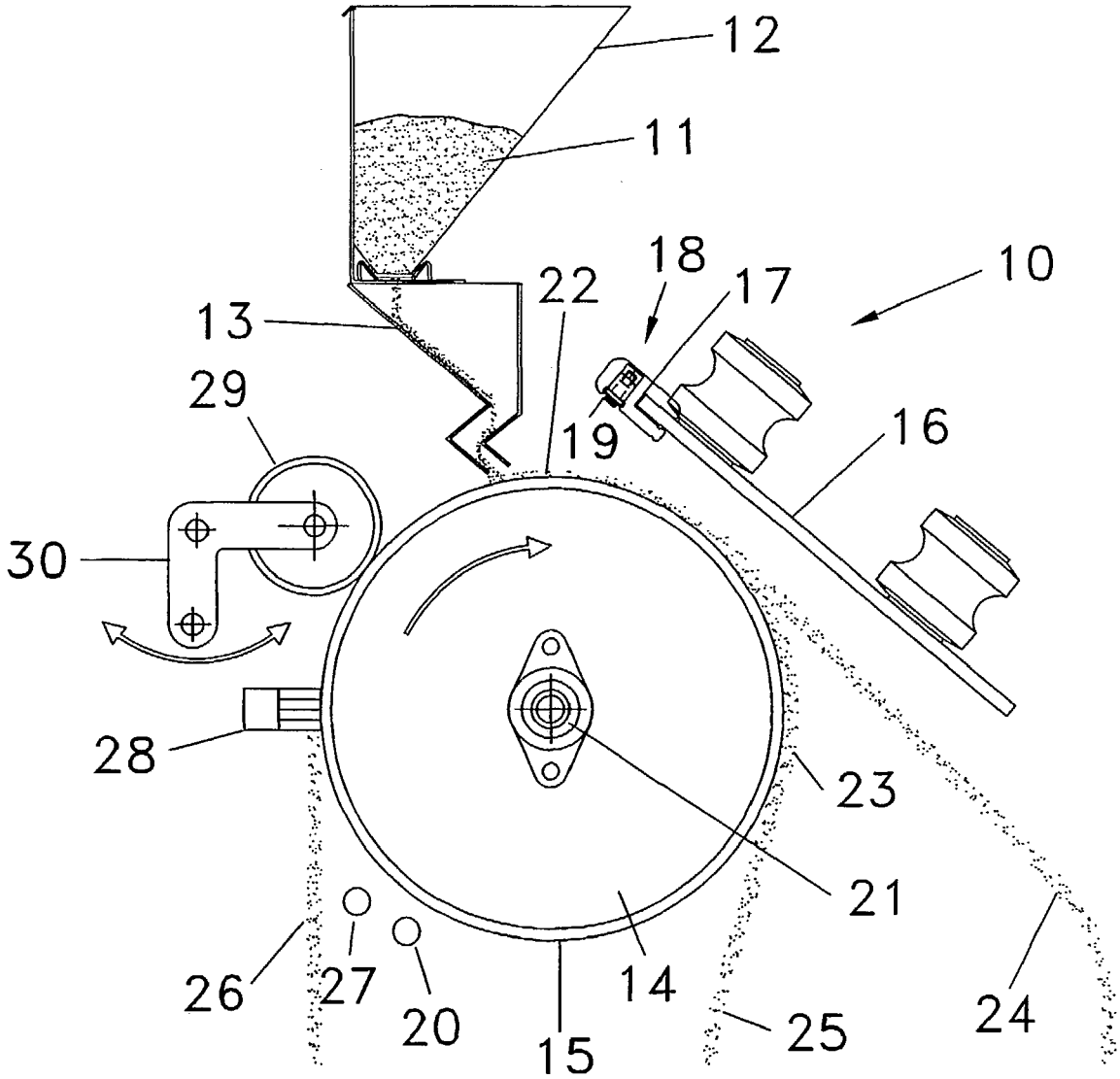
FIG. 1 is an elevation showing apparatus in accordance with a first embodiment of the present invention.

The apparatus 10, 110, 210, 310, 410 and 510 shown in FIGS. 1, 2, 3, 5, 6 and 8, respectively, is a particle separator used to separate particulate mixtures comprising species that exhibit difference in electrical conductivity. In particular, the apparatus serves to separate electrically conducting species from non-conducting species on the basis of their differing capacities to retain charge in a roll-type electrostatic separator. The devices are substantially similar and therefore the overall operation shall be described with reference to FIG. 1 only, and variations shall be described with reference to FIGS. 2 to 8. In view of the similarity of the devices, reference numerals in FIGS. 2 to 8 will be the same as those in FIG. 1 for similar features, except that the features will be numbered from 110, 210, 310, 410 and 510 in FIGS. 2, 3, 4, 5, 6 and 8, respectively.

Referring to FIG. 1, a mixture of particulate material 11 is contained within hopper 12 and fed via a feed metering plate through feeding means, in this case a simple chute 13, onto roll 14. The particulate material 11 may also be fed onto the roll 14 by other suitable means such as a roll feeder system, with or without a variable speed drive. The path followed by the feed material and the configuration of the chute may be varied in order to suit the nature of the feed material and other operating parameters, as would be well understood by the person skilled in the art.

The roll 14 has an exterior surface 15 which is made of a conductive material, in this case, a chrome material. The roll 14 rotates at a speed of around 150 to 250 rpm and carries with it the particulate mixture 11 as it rotates. In this instance the roll 14 rotates in the clockwise direction, but it may also rotate in the anti-clockwise direction if desired. The apparatus includes appropriate drive mechanisms and control mechanisms, as would be well understood by the person skilled in the art. The roll diameter is typically 200 mm to 400 mm in the apparatus shown. The roll 14 is mounted for rotation upon axle 21, as would be well understood by the person skilled in the art.

Figure 7:
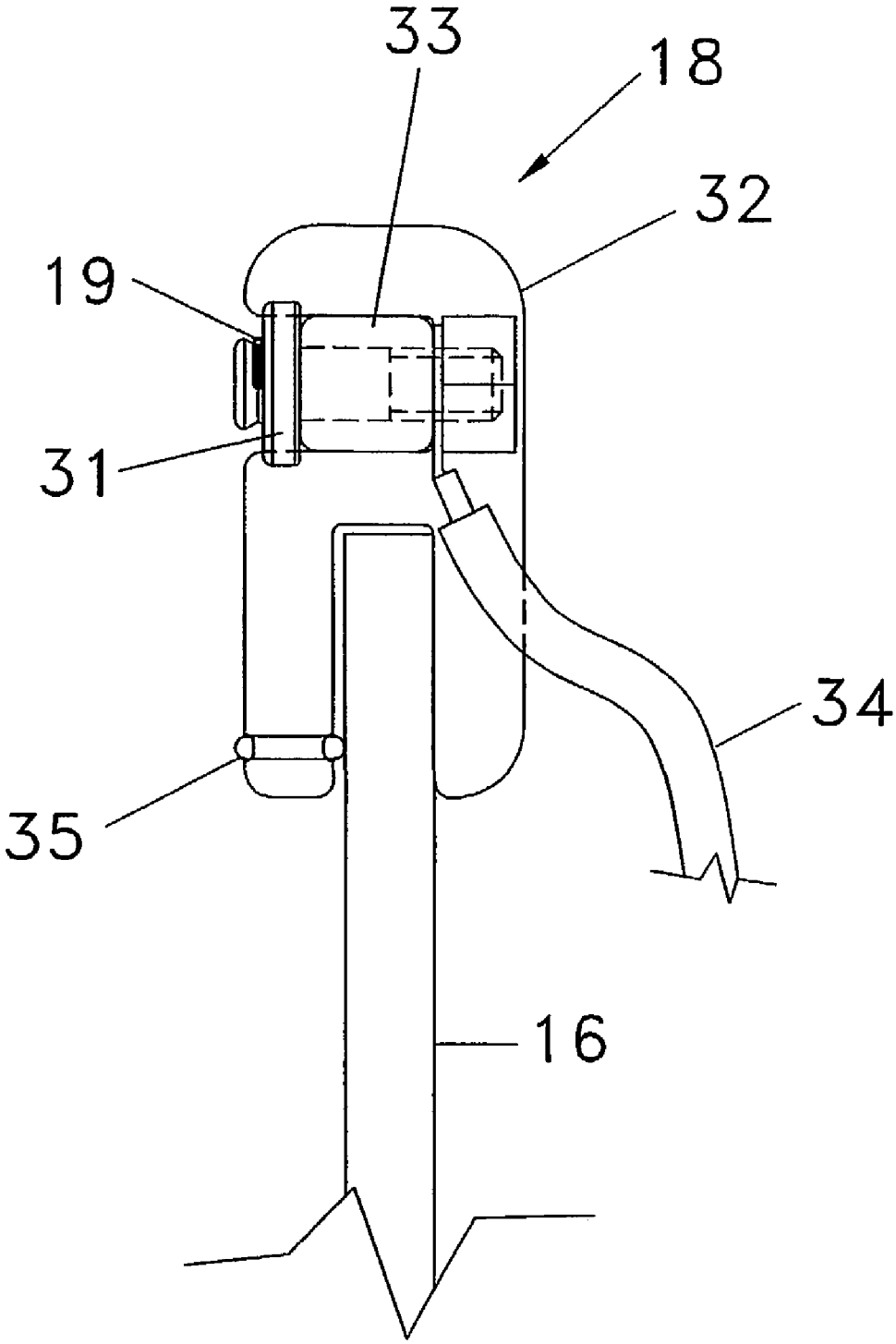
FIG. 7 is an elevation showing detail of the corona wire support member of FIGS. 1 to 6.
Figure 8:
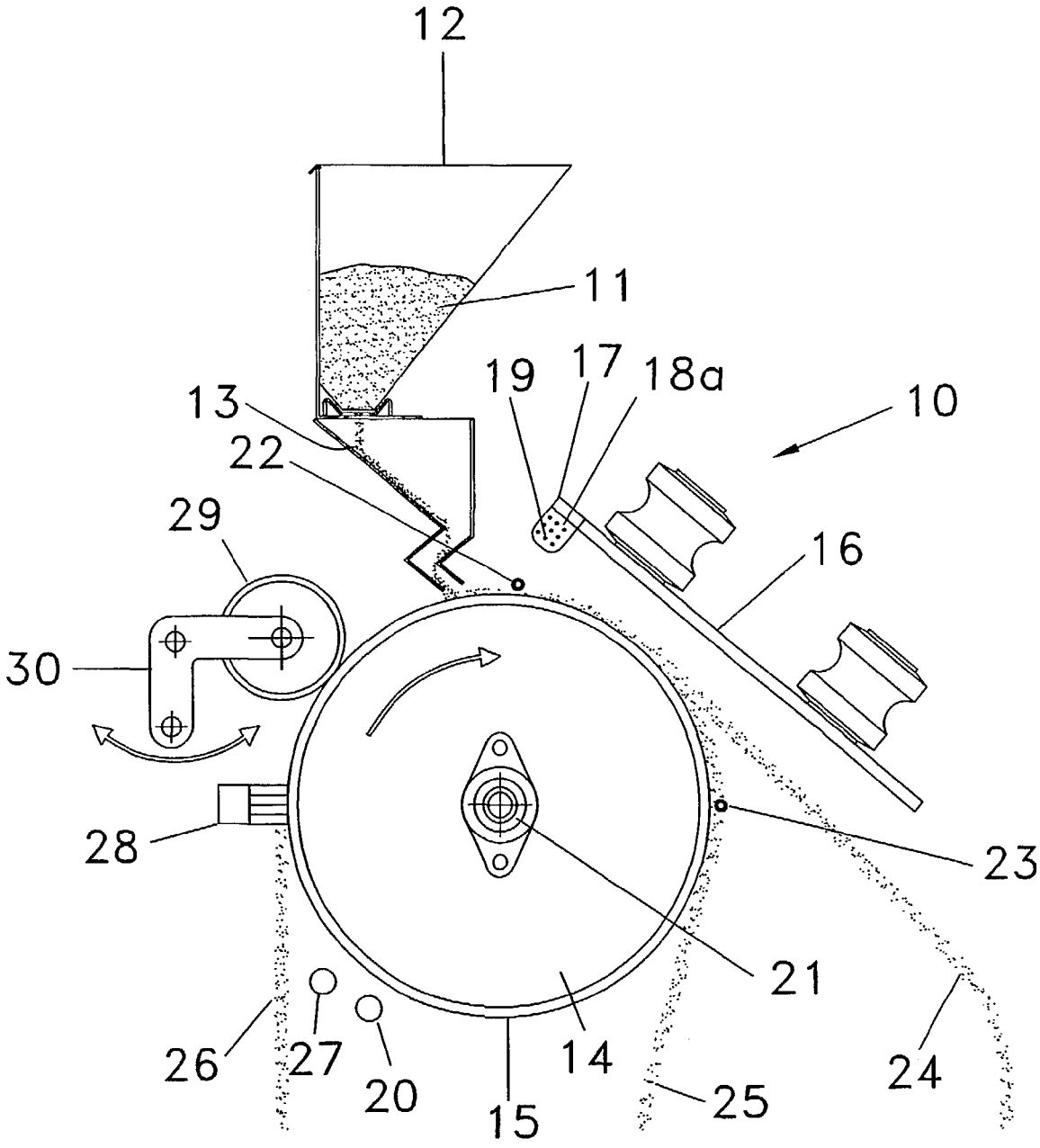
FIG. 8 shows an alternative means of locating the corona wire.

The apparatus 10 includes an ionising electrode. This is a corona electrode comprising a corona wire 19. The apparatus also includes a first static electrode 16 spaced apart from the exterior surface 15 of the roll 14. Detail of the corona wire support member 18 is best seen in FIG. 7. The corona wire support member 18 in each instance comprises a tensioning screw 31 which screws into an appropriate cavity in a backing bar 33, located within a well in clip 32. The backing bar 33 is an insulated metal rod which becomes an extension of the first static electrode 16, ensuring a large continuous static field at the roll surface adjacent to the corona wire 19. A high voltage power supply is connected to the corona support assembly 18 via lead 34. It is to be noted that the clip 32 is made of an insulating material and incorporates a rubber "O" ring 35 that clamps to the surface of the first static electrode 16, taking up any variation in its thickness. Since the backing bar 33 is insulated along its length, the wire tensioning screws 31 and the corona wire 19 are the only exposed high voltage parts. The position of the corona wire 19 may be adjusted relative to the first static electrode 16 by adjusting the length of the tensioning screws 31. This results in a change in the relativity between the corona and static field strengths. However, this is preferably done through provision of two or more separate high voltage power supplies, one connected to the corona wire 19 and at least one other connected to the first static electrode 16. Alternatively, the corona wire 519 could extend through a perforation in the perforated plate 518 attached to the leading edge 517 of the static electrode 516, as shown in FIG. 8. In this embodiment, the spacing of corona wire 519 and the leading edge 517 of static electrode 516 is determined by selection of the perforation in the perforated plate 518 through which the corona wire extends.

As illustrated in FIG. 1, the particulate mixture 11 is fed onto the exterior surface 15 of the roll 14 the particles in the mixture become charged under the influence of the high voltage ionising field emanating from the corona wire 19. Since the static electrode 16 has the same polarity as the ionising electrode, this ensures immediate repulsion of the ionised particles by the static electrode which pushes the particles onto the exterior surface 15 of the roll 14. In so doing, particle bounce is greatly reduced as the repulsion force on ionised particle acts immediately and continuously, even during the process of ionisation of the mixture. Furthermore, the static electrode 16 begins to induce a neutral (or even negative) charge to the conducting particles in the particulate mixture 11 immediately, and continues this whilst the particles are under the influence of the static electric field generated by the static electrode 16. An electric field is present over a wide arc, extending essentially from the point of ionisation 22 to a point 23 on the roll 14 where the static electric field has substantially diminished. This ensures repulsion of charged non-conductors occurs over a large area of the roll, and specifically the area of the roll where most conductors are dislodged from the exterior surface 15 of the roll 14. This is represented in showing a stream 24 of conductors which are thrown off the roll 14 by a combination of centrifugal force and gravity in a direction generally tangential to the roll. The conductor stream 24 is collected in a manner known per se. Meanwhile, a mid-conductor stream 25 is retained upon the exterior surface 15 of the roll 14 for a time, before charge decay causes these particles to be dislodged, but non-conducting particles are retained on the roll until dislodged as a non-conductor stream 26.

The static electrode 16 and corona wire 19 are connected to one or two high voltage power supplies of like polarity, and may be operated at the same or different voltages. A preferred embodiment includes separate high voltage power supplies of like polarity connected to each electrode, allowing each to be separately adjusted and optimised. The static electrode 16 can be a metal conducting electrode or an insulated dielectric type such as described in International Application No. PCT/AU00/00223 (WO 00/56462), the disclosure of which is incorporated herein by reference.

The non-conductors, unlike conducting particles, do not give up their charge to the grounded exterior surface 15 of the roll 14. Thus, an "image force" pins the non-conductors to the roll, and likewise with mid-conductors, although charge decay does occur slowly. Therefore, mid-conductors are held on the roll 14 until charge decay occurs sufficiently for them to be thrown off. This is some time after charge decay of the conductors has been completed and these have been thrown off. As shown in FIG. 1, ordinarily sufficient decay has occurred for the combined centrifugal and gravitational forces at point 23 on the roll 14 to throw the mid-conductor stream 25 from the roll 14. However, the non-conductors remain on the roll until removed therefrom by conventional means. In the present apparatus, AC electrodes 20, 27 neutralise the charge on the non-conductors as they pass by. However, since charge neutralisation may not be complete, a brush 28 is provided which sweeps the non-conductor stream 26 from the roll 14. Both the non-conductors and the mid-conductors are collected in a manner known per se.

The apparatus also includes a roll cleaning device which consists of a linish roll 29 brought into contact or out of contact with the exterior surface 15 of the roll 14 through mechanism 30 in a manner which would be well understood by the person skilled in the art. Control means such as proximity switches and the like will generally be present. The linish roll 29 will be brought into contact with the exterior surface 15 on occasion to clean the surface, but removed from contact with the surface for the majority of the time in order to avoid excessive abrasion of the surface. When in contact with the exterior surface 15, the linish roll 29 slowly rotates to clean the surface of the roll 14 as it moves past the linish roll. Cleaning the exterior surface 15 of the roll 14 in this way ensures that the chrome surface has adequate conductivity for charge decay to occur at a sufficiently rapid rate. A chrome surface is readily cleaned in this fashion, but other, conventional conducting surfaces may be used on the roll 14. In addition, other cleaning mechanisms may be used, and these include abrasive rubbing devices and/or rolls or other mechanisms that are brought into contact with the roll 14 on a intermittent basis.

Figure 2:
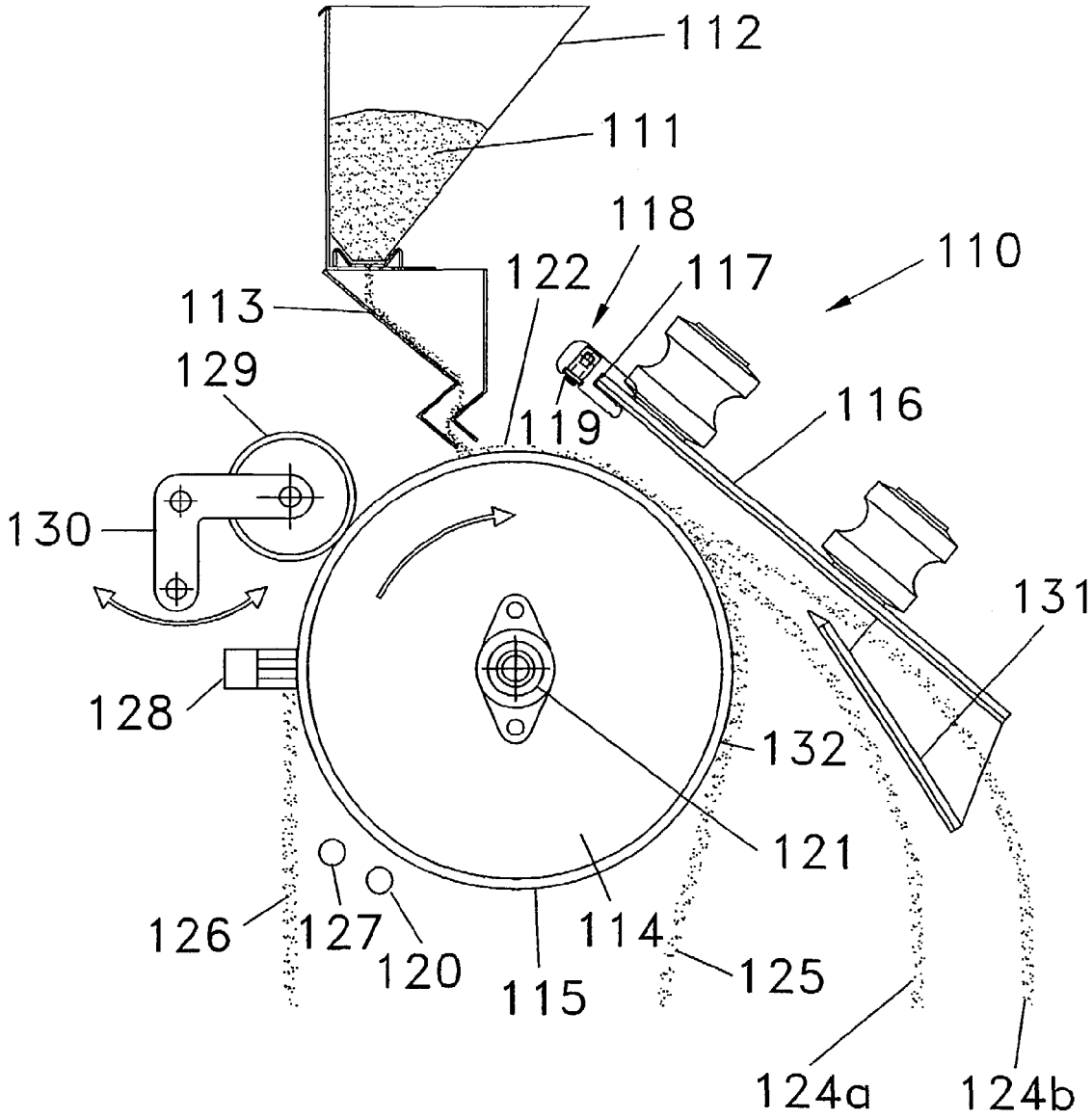
FIG. 2 is an elevation showing apparatus in accordance with a second embodiment of the present invention, which includes a second static electrode.

Referring now to FIG. 2, it will be seen that a second static electrode 131 is introduced. Therefore the conductor stream splits into two streams, stream 124A which passes between the second static electrode 131 and the roll 114 and stream 124B which passes between the second static electrode 131 and the first static electrode 116. The second static electrode 131 serves to extend the static electric field further around the roll 114; compare point 23 in FIG. 1 to point 132 in FIG. 2. Thus, there is a greater zone in which the repulsion and charge decay effects described above with reference to FIG. 1 occur, and therefore the ionised particles are subjected to these forces for a longer duration. This ensures that there is greater separation efficiency.

Figure 3:
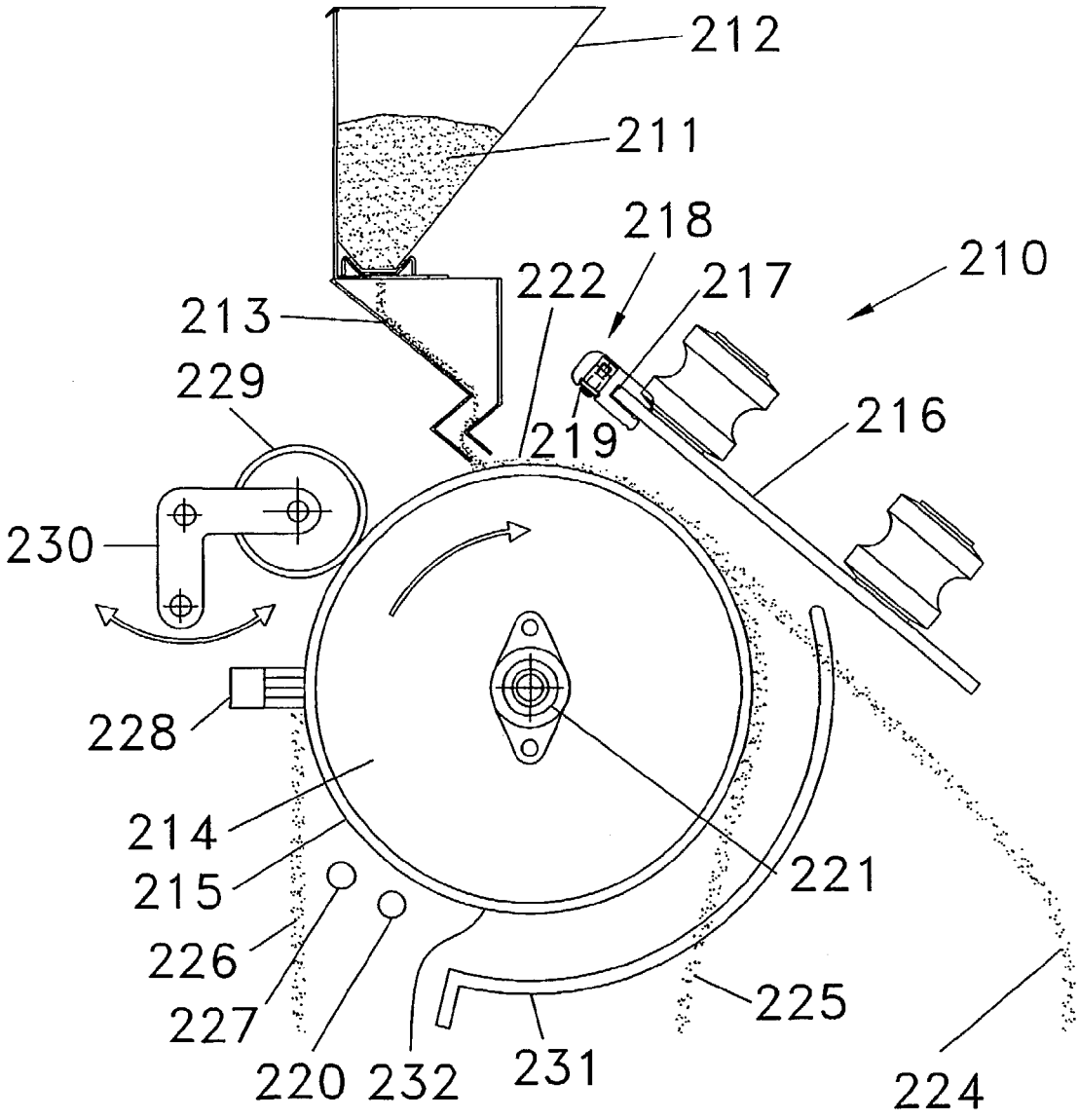
FIG. 3 is an elevation of apparatus in accordance with a third embodiment of the present invention, which employs a finger electrode.

Referring now to FIG. 3, it will be seen that the second static electrode 231 differs from that shown in FIG. 2 in that it is curved in cross-section and extends substantially around the diameter of the roll 214. This extends the static field to a point 232 at approximately the lowest point of the roll 214. In this embodiment of the invention the repulsion effect which maintains non-conductors on the roll 214 is the primary effect enhanced.

Figure 4:
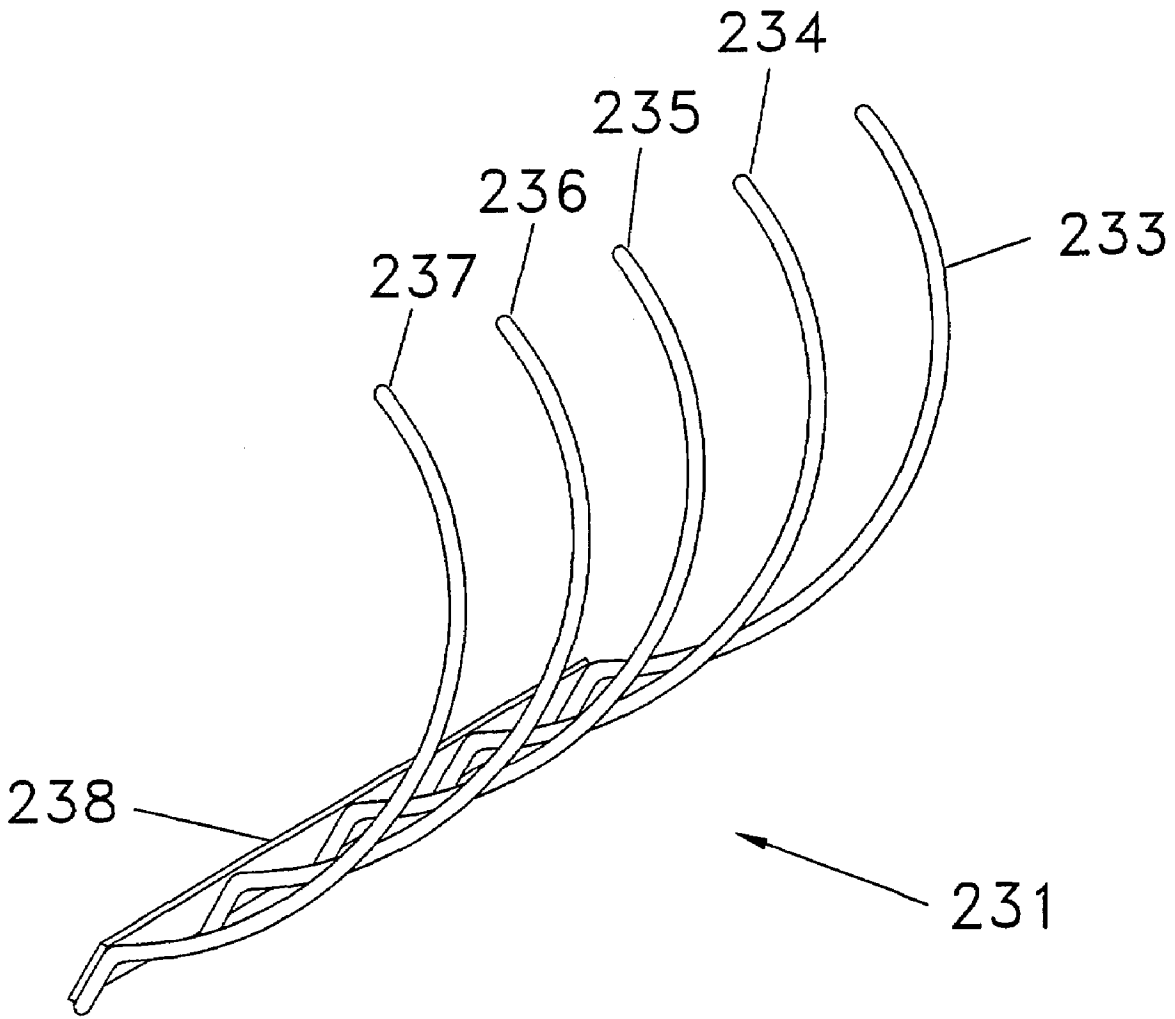
FIG. 4 is an isometric view of a finger electrode.

The electrode used in FIG. 3 is a finger electrode of the type illustrated in FIG. 4 since, from FIG. 3, it will be appreciated that both the conductor stream 224 and the mid-conductor stream 225 pass the static electrode 231.

Reference to FIG. 4 shows that the static electrode 231 comprises 5 parallel fingers 233, 234, 235, 236, 237 cantilever supported at the base by base member 238. In the embodiment of the invention shown in FIG. 3 the finger electrode 231 is installed with the individual finger spaced apart from the exterior surface 215 of the roll 214, and installed concentric with the exterior surface 215. These individual fingers are spaced apart at a distance that provides for reasonably uniform electric field strength at the roll surface 215, typically 20 to 75 mm. It will be appreciated that the conductor stream 224 and the mid-conductor stream 225 may pass through the finger electrode 231 with few, if any, of the particles coming into contact with the electrode, and therefore these streams will not be substantially scattered. Even if there is contact, it will generally be glancing contact and the particles may still be collected. The finger electrode 231 is insulated from the ground and is charged to a high voltage with the same polarity as that of the other electrodes. However, the voltage may be of the same or different magnitude to those employed in the other electrodes.

Figure 6:
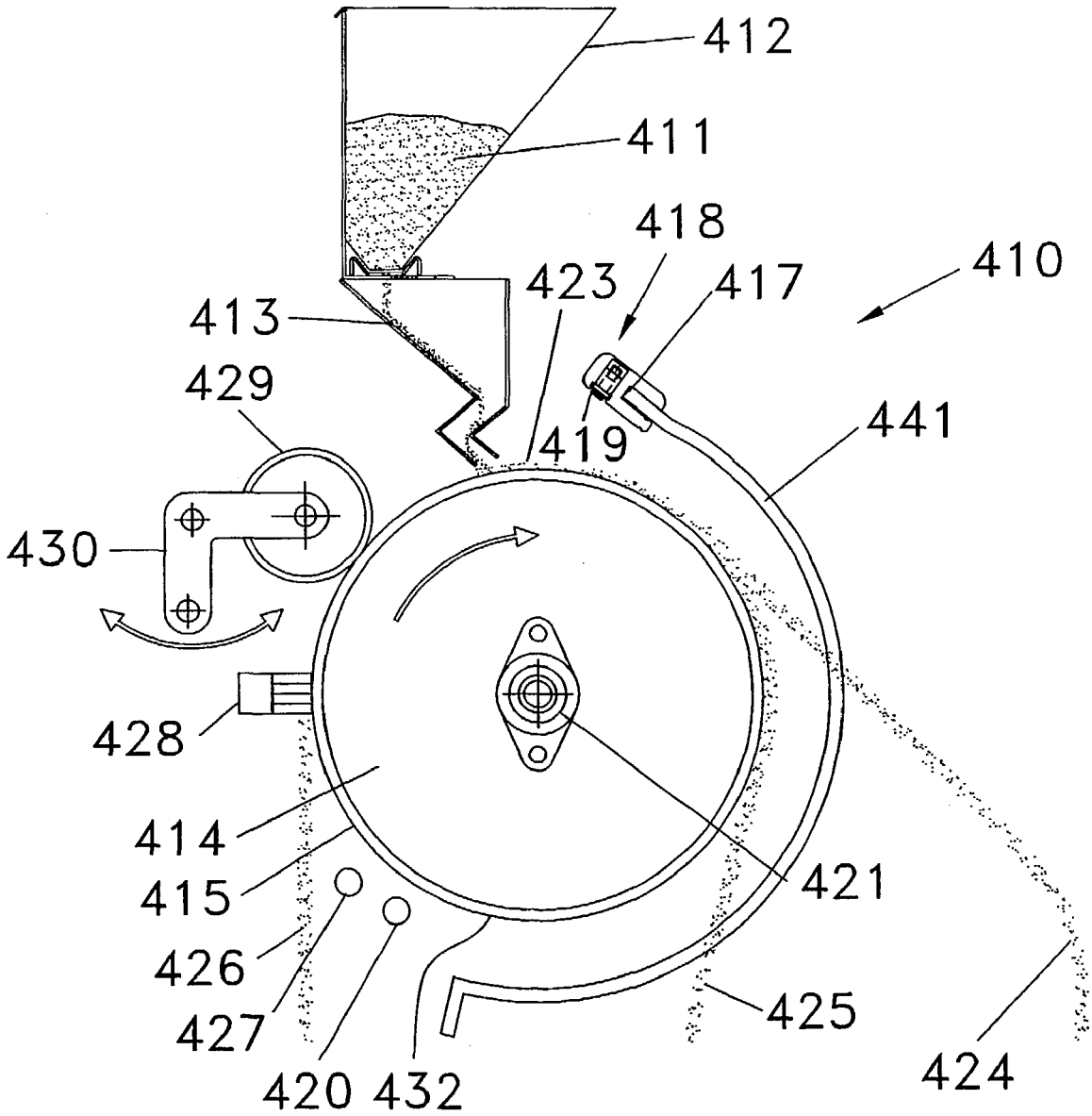
FIG. 6 is an elevation of a fifth embodiment of the invention, which employs an extended static electrode.

As shown in FIG. 6, a finger electrode 441 may be used which extends substantially around the roll 414 and replaces entirely conventional static electrode designated 16 in FIG. 1. In this embodiment of the invention the finger electrode 441 functions in the same manner as the static electrode 16, as described above for the electrode 231.

Figure 5:
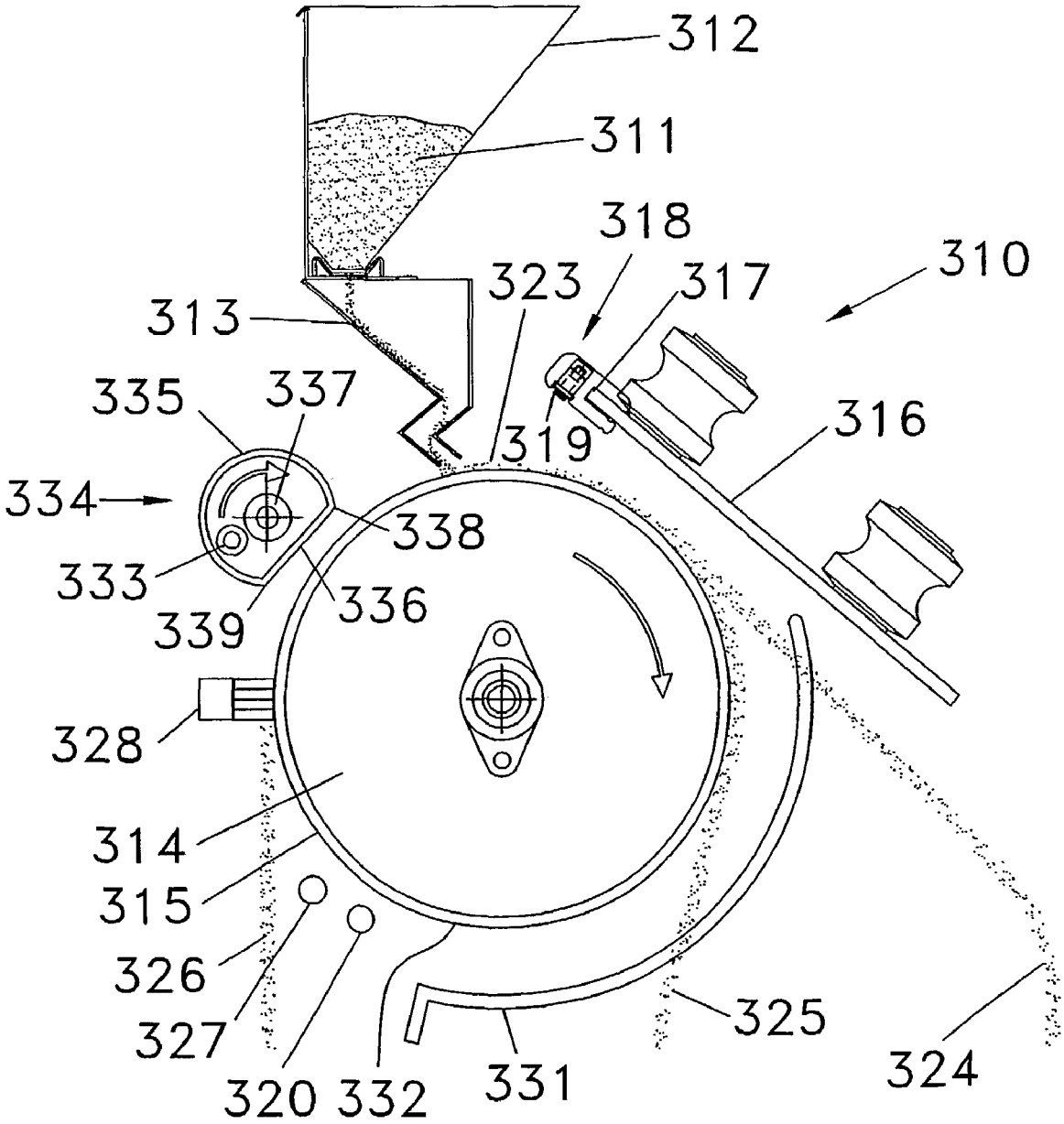
FIG. 5 is an elevation of apparatus in accordance with a fourth embodiment of the present invention, which illustrates a cleaning arrangement utilising a linish roll with a flattened face.

Referring now to FIG. 5, it will be appreciated that the apparatus may include a novel cleaning mechanism which comprises a linish roll 334 which has a flattened face 336 and a rounded face 335 which rotates around axle 337. The linish roll 334 rotates in a clockwise direction and therefore, as shown, when the flattened face 336 is adjacent the exterior surface 315 of the roll 314 it does not contact the roll. However, when rounded face 335 comes into a position adjacent the roll 314, the surface of the linish roll bears upon the exterior surface 315 of the roll 314, and continues to do so as the linish roll rotates. It is not until a full rotation from one end 338 to the other end 339 of the rounded face 335 is completed that the contact between the linish roll 334 and the exterior surface 335 is broken. The linish roll may rotate continuously or intermittently. Therefore, when the linish roll is stopped it is stopped in the position shown in FIG. 5 so that it does not make contact with the exterior surface 315 of the roll 314. A position sensor 333 and control system may be used to determine when the flattened face 336 of the linish roll 334 is adjacent the roll 314 and to stop or start its rotation.

INDUSTRIAL APPLICABILITY

The particle separator of the present invention is useful in separating particles which differ in their electrical conductivity such as in the mineral processing industry. In particular, the invention is useful in titanium mineral process plants. However, many applications exist in areas such as scrap recovery, iron ore or industrial mineral beneficiation processes, whereby this invention can be used to greatly enhance product recovery and grades of material.

The invention claimed is:

1. Apparatus for the electrostatic separation of a mixture of particles that exhibit difference in electrical conductivity, comprising:

a conductive surface to which conducting particles lose their charge;

feeding means for feeding the mixture of particles onto the conductive surface;

an ionizing electrode for ionizing individual particles in the mixture of particles; and a first static electrode having the same polarity as the ionizing electrode and which serves to generate a static electric field, the first static electrode being located sufficiently close to the ionizing electrode that the static electric field acts continuously on the particles as they are ionized, and being of sufficient length to continue to act on the particles once ionized;

wherein conducting particles are separated from non-conducting particles on the basis of their different retained charge after a period of contact with the conductive surface, said apparatus further comprising a second static electrode which serves to extend the distance over which the static electric field is applied to the conductive surface.

2. Apparatus as claimed in claim 1 wherein the second static electrode comprises a plurality of spaced apart fingers.

3. Apparatus as claimed in claim 2 wherein the spaced apart fingers are substantially parallel.

4. Apparatus as claimed in claim 3 wherein the spaced apart fingers are mounted to a base member at regular intervals.

5. Apparatus as claimed in claim 2 wherein each of the spaced apart fingers is shaped in the image of the conductive surface.

6. Apparatus as claimed in claim 5 wherein the conductive surface is generally cylindrical and therefore each of the spaced apart fingers is curved with substantially the same degree of curvature.

7. Apparatus for the electrostatic separation of a mixture of particles that exhibit difference in electrical conductivity, comprising:

a conductive surface to which conducting particles lose their charge;

feeding means for feeding the mixture of particles onto the conductive surface;

an ionizing electrode for ionizing individual particles in the mixture of particles; and a first static electrode having the same polarity; as the ionizing electrode and which serves to generate a static electric field, the first static electrode being located sufficiently close to the ionizing electrode that the static electric field acts continuously on the particles as they are ionized, and being of sufficient length to continue to act on the particles once ionized;

wherein conducting particles are separated from non-conducting particles on the basis of their different retained charge after a period of contact with the conductive surface, and wherein one or both of the first and second static electrode is a dielectric electrode.

8. Apparatus for the electrostatic separation of a mixture of particles that exhibit difference in electrical conductivity, comprising:

a conductive surface to which conducting particles lose their charge;

feeding means for feeding the mixture of particles onto the conductive surface;

an ionizing electrode for ionizing individual particles in the mixture of particles; and a first static electrode having the same polarity as the ionizing electrode and which serves to generate a static electric field, the first static electrode being located sufficiently close to the ionizing electrode that the static electric field acts continuously on the particles as they are ionized, and being of sufficient length to continue to act on the particles once ionized;

wherein conducting particles are separated from non-conducting particles on the basis of their different retained charge after a period of contact with the conductive surface, and wherein the conductive surface is a chrome surface.

9. Apparatus for the electrostatic separation of a mixture of particles that exhibit difference in electrical conductivity, comprising:

a conductive surface to which conducting particles lose their charge;

feeding means for feeding the mixture of particles onto the conductive surface;

an ionizing electrode for ionizing individual particles in the mixture of particles; and a first static electrode having the same polarity as the ionizing electrode and which serves to generate a static electric field, the first static electrode being located sufficiently close to the ionizing electrode that the static electric field acts continuously on the particles as they are ionized, and being of sufficient length to continue to act on the particles once ionized;

wherein conducting particles are separated from non-conducting particles on the basis of their different retained charge after a period of contact with the conductive surface, and further comprising cleaning means for cleaning the conductive surface and wherein the cleaning means are applied intermittently to said conductive surface and wherein the cleaning means comprises a highly abrasive cleaner and wherein the cleaner is a rotating abrasive linish roll.

10. Apparatus as claimed in claim 9 wherein the linish roll has a rounded face and a flattened face and rotates continuously or intermittently adjacent the conductive surface so as to contact it only when the rounded face and the conductive surface are juxtaposed.

11. Apparatus as claimed in claim 9, further comprising means for bringing the linish roll in to and out of engagement with the conductive surface.

12. A multi-stage particle separator for the separation of particulate mixtures comprising species that exhibit difference in electrical conductivity, comprising apparatus for the electrostatic separation of a mixture of particles that exhibit difference in electrical conductivity, comprising:

a conductive surface to which conducting particles lose their charge;

feeding means for feeding the mixture of particles onto the conductive surface;

an ionizing electrode for ionizing individual particles in the mixture of particles; and a first static electrode having the same polarity as the ionizing electrode and which serves to generate a static electric field, the first static electrode being located sufficiently close to the ionizing electrode that the static electric field acts continuously on the particles as they are ionized, and being of sufficient length to continue to act on the particles once ionized;

wherein conducting particles are separated from non-conducting particles on the basis of their different retained charge after a period of contact with the conductive surface, and in operative association with a further particle separator or separators.

* * * * *